US005351787A

United States Patent [19]

Hoch et al.

[11] Patent Number: 5,351,787

[45] Date of Patent: Oct. 4, 1994

[54] ELEVATOR

[75] Inventors: Frederick Hoch, Middletown; Robert Buonora, Camp Hill, both of Pa.

[73] Assignee: Inclinator Company of America, Harrisburg, Pa.

[21] Appl. No.: 154,122

[22] Filed: Nov. 18, 1993

Related U.S. Application Data

[63] Continuation of Ser. No. 9,081, Jan. 26, 1993, abandoned.

[51] Int. Cl.[5] ..... B66B 11/04

[52] U.S. Cl. ..... 187/253

[58] Field of Search ..... 187/17, 20

[56] References Cited

U.S. PATENT DOCUMENTS

| | | | |
|---|---|---|---|
| 65,200 | 5/1867 | Flad et al.. | 187/17 |
| 356,496 | 1/1887 | Otis | 187/17 |
| 488,891 | 12/1892 | Hall | 187/17 |
| 670,466 | 3/1901 | Bolander | 187/17 |
| 2,086,002 | 7/1937 | Shepard | 187/17 |
| 2,860,729 | 11/1958 | Stoddard et al. | 187/17 X |
| 2,906,374 | 9/1959 | Brumby | 187/17 |
| 3,757,899 | 9/1973 | Smith | 187/17 |
| 3,905,496 | 9/1975 | Reeder | 187/17 X |
| 3,934,681 | 1/1976 | Herrell | 187/17 |
| 4,180,145 | 12/1979 | Capps | 187/17 |

FOREIGN PATENT DOCUMENTS

| | | |
|---|---|---|
| 52-64743 | 5/1977 | Japan . |
| 223189 | 1/1990 | Japan . |
| 1252279 | 8/1986 | U.S.S.R. . |
| 16832 | 12/1887 | United Kingdom . |
| 1496878 | 1/1978 | United Kingdom . |

*Primary Examiner*—Robert P. Olszewski
*Assistant Examiner*—Dean A. Reichard
*Attorney, Agent, or Firm*—Fred Philpitt

[57] ABSTRACT

A home elevator system consisting of a combination of a single vertical guide rail consisting of two C-shaped channels that are interconnected along the entire vertical height of the guide rail, an elevator platform having a central portion which is slidably mounted within the single vertical guide rail, a hydraulic jack, and a rope and pulley arrangement interconnecting the platform, guide rail and hydraulic jack comprising a first pulley mounted on the top of the single vertical guide rail, a second pulley adjacent the bottom of the hydraulic jack, a third pulley connected to the outer end of the hydraulic jack and a rope travelling over pulleys.

1 Claim, 1 Drawing Sheet

ELEVATOR

RELATED APPLICATION

This application is a continuation of our prior application Ser. No. 08/009,081 filed Jan. 26, 1993.

This invention pertains to a simple elevator arrangement that can be installed in homes and small buildings where only a very limited amount of space is available.

BACKGROUND

The home elevator systems currently on the market are bulky and require a considerable amount of space in order to accommodate guide rails, a hydraulic jack, a pit, an elevator supporting mechanism, etc. The object of the present invention is to provide an elevator arrangement that requires a minimum of space, is simple to install and easy to maintain.

SUMMARY OF THE INVENTION

Our invention pertains to an elevator arrangement especially suited for use in a home which comprises a platform having a portion thereof that is slidably mounted within a guide rail so as to move vertically up and down with respect to said guide rail, a hydraulic jack in the form of a piston and cylinder mounted closely adjacent to said guide rail, and a rope and pulley arrangement interconnecting said platform, said guide rail and said hydraulic jack.

DESCRIPTION OF PREFERRED EMBODIMENT

Figure 1:
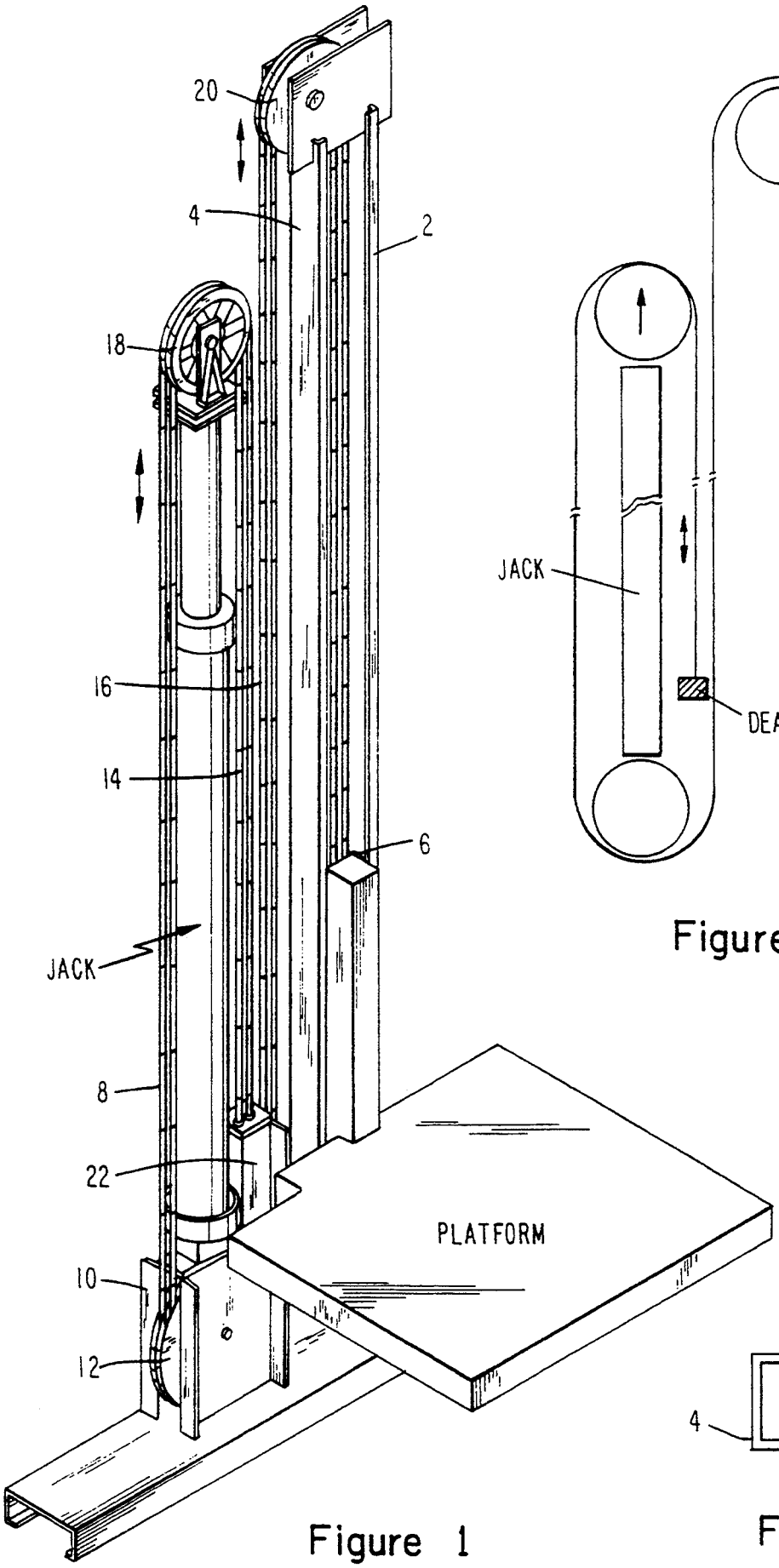
FIG. 1 is a perspective view of our elevator arrangement.

A preferred embodiment of our elevator arrangement is illustrated in FIG. 1. A single vertical guide rail 2, 4 is mounted on a base. An elevator platform has a vertical portion that contains rollers 6 that are adapted to roll or slide up and down within the C-shaped side sections of the guide rail 2, 4. A hydraulic jack consisting of a hydraulic piston and cylinder is mounted next to the guide rail 2, 4 and this jack can be actuated to extend and retract in a well known manner by connections and controls which are not shown because they are conventional. As shown, the bottom of the cylinder is anchored while the piston end is free to be moved up and down.

Figure 2:
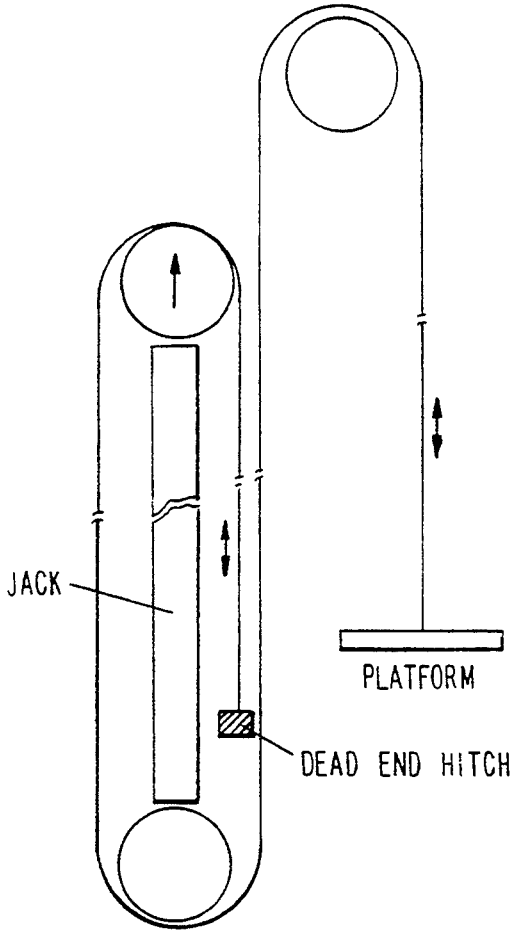
FIG. 2 is a schematic view of our pulley arrangement.
Figure 3:
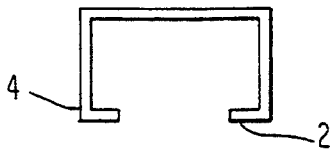
FIG. 3 is an end view of our guide rail.

A rope and pulley arrangement interconnects the elevator platform, the guide rail 2, 4 and the hydraulic jack. A first pulley 20 is mounted in a fixed location near the top of the guide rail 2, 4. A second pulley 12 is mounted in a bracket 10 at a fixed location near the bottom of the hydraulic jack. A third pulley 18 is mounted on the outer end of the piston of the hydraulic jack so that it will move up and down as the piston moves up and down. A rope, a cable or the like has one end joined to anchor point 22 on bracket 10, which is shown as being near the lower portion of the hydraulic cylinder and also near the lower portion of the guide rail 2, 4. From anchor point 22 the rope 14 extends upwardly and over the third pulley 18 and thereafter downwardly and around the second pulley 12. From the second pulley 12 the rope rises upwardly (see 16) to the first pulley 20, and after passing around this pulley extends downwardly where its other end is joined in any suitable manner to the elevator platform and/or some extended portion of the elevator platform. FIG. 2 is a schematic illustrating the rope and pulley arrangement.

Since our guide rail 2, 4 is a single unitary mast mounted on a solid fixed base there is no possibility that the C-shaped side channels in which the rollers ride can become misaligned with respect to each other.

Our elevator arrangement is particularly useful for homes and small commercial buildings because it can fit into a very limited amount of space as compared with the amount of space usually required for such elevators. Furthermore, it is of simple, rugged construction and can easily be maintained or repaired because all of the essential parts are located close together.

We claim:

1. An elevator arrangement especially suited for use in a home which consists of a combination of (a) a single vertical guide rail (2, 4) that consists of two C-shaped channels that are interconnected along the entire vertical height of the guide rail, (b) an elevator platform having a central portion which is slidably mounted within said single vertical guide rail (2, 4) so as to move on rollers vertically up and down within said two continuously interconnected C-shaped channels, said platform extending laterally outwardly from both sides of said single vertical guide rail (2, 4), (c) a hydraulic jack in the form of a piston and cylinder, mounted closely adjacent to said guide rail (2, 4), and (d) a rope and pulley arrangement interconnecting said platform, said guide rail and said hydraulic jack comprising (1) a first pulley (20) mounted on the top of said single vertical guide rail (2, 4), (2) a second pulley (12) at a fixed location adjacent the bottom of said hydraulic jack, (3) a third pulley (18) connected to the outer end of the piston of said hydraulic jack that moves as the piston moves, and (4) a rope which has one end anchored at a point which is near the lower portions of both said hydraulic jack and said single vertical guide rail (2, 4), then travels up and over said third pulley (18), then down and around said second pulley (12), then up and around said first pulley (20) and then downwardly where its other end is connected to said elevator platform.

* * * * *